United States Patent [19]

Yashiki et al.

[11] Patent Number: 4,610,942

[45] Date of Patent: Sep. 9, 1986

[54] ELECTROPHOTOGRAPHIC MEMBER HAVING CORRESPONDING THIN END PORTIONS OF CHARGE GENERATION AND CHARGE TRANSPORT LAYERS

[75] Inventors: Yuichi Yashiki, Yokohama; Takashi Tanaka, Kawasaki, both of Japan

[73] Assignee: Canon Kabushiki Kaisha, Tokyo, Japan

[21] Appl. No.: 700,969

[22] Filed: Feb. 12, 1985

[30] Foreign Application Priority Data

Feb. 16, 1984 [JP] Japan ..... 59-26044

[51] Int. Cl.[4] ..... G03G 15/02; G03G 5/00

[52] U.S. Cl. ..... 430/58; 430/59; 430/132; 430/133; 430/134

[58] Field of Search ..... 430/58, 59, 133, 132, 430/134

[56] References Cited

U.S. PATENT DOCUMENTS

| | | | |
|---|---|---|---|
| 3,684,548 | 8/1972 | Contois | 430/133 |
| 3,849,128 | 11/1974 | Ihara | 430/133 |
| 4,001,014 | 1/1977 | Ando et al. | 430/58 |
| 4,430,404 | 2/1984 | Hosoya et al. | 430/58 |
| 4,481,273 | 11/1984 | Katagiri et al. | 430/59 |

FOREIGN PATENT DOCUMENTS

| | | | |
|---|---|---|---|
| 2527797 | 12/1983 | France | 430/133 |
| 0128740 | 10/1979 | Japan | 430/134 |
| 0124735 | 8/1982 | Japan | 430/132 |

*Primary Examiner*—John E. Kittle
*Assistant Examiner*—Mukund J. Shah
*Attorney, Agent, or Firm*—Fitzpatrick, Cella, Harper & Scinto

[57] ABSTRACT

An electrophotographic photosensitive member having a conductive substrate and a photosensitive laminate comprising a charge generation layer and a charge transport layer formed by dip coating, characterized in that the charge transport layer has a portion where the thickness increases gradually from the upper end of the layer and the charge generation layer has a portion formed, correspondingly to the increasing thickness portion of the charge transport layer, so as to increase the thickness gradually from the upper end of the layer.

14 Claims, 6 Drawing Figures

ELECTROPHOTOGRAPHIC MEMBER HAVING CORRESPONDING THIN END PORTIONS OF CHARGE GENERATION AND CHARGE TRANSPORT LAYERS

BACKGROUND OF THE INVENTION

1. Field of the Invention

The present invention relates to a separate function type of electrophotographic photosensitive member having a charge generation layer and a charge transport layer formed by dip coating.

2. Description of the Prior Art

It has been widely practiced up to now that a resin layer or a photosensitive layer is formed on a substrate by coating to produce an electrophotographic photosensitive member. Among various coating methods, the dip coating method that comprises dipping a substrate in a coating solution and taking up the substrate is specially favorable since the substrate in arbitrary form can be neatly coated thereby.

In dip coating, the coating thickness, when the coating material is given, depends on the concentration thereof and on the take-up speed. It is known that the coating thickness increases with the concentration and with the take-up speed.

However, when the take-up speed is high, the coating material on the substrate sags before setting by drying, thus forming an uneven coating which becomes thinner upward, i.e. becomes thicker downward. In particular, when the concentration of active materials in the coating solution, the sagging tends to occur even if the viscosity of the coating solution is raised, because of a large amount of solvents in the coating solution.

This tendency is remarkable specially in the coating to form charge transport layers of the separate function type electrophotographic photosensitive members having charge generation and charge transport layers. Generally the charge transport layer is formed by applying an electron donative material or electron attractive material together with a film-formable resin dissolved in a solvent, where the solvent needs to be used in a large proportion because electron donative or attractive materials commonly have low solubilities in solvents. Consequently the coating solution for the charge transport layer is dilute, and for the purpose of thickening the charge transport layer to a certain extent, the viscosity of the coating solution is raised. When such a dilute coating solution is applied on a substrate by dip coating, a large portion of the coat, before setting, descends the substrate during the take-up thereof, since the drying of the coat is slow because of the high concentration of solvents. This phenomenon generates an uneven coating thickness as shown in FIG. 1, where the distance from the upper end of the coat is plotted as abscissa and the thickness of the formed charge transport layer as ordinate. Thus the coating thickness decreases upward.

Such uneven thickness of the charge transport layer causes irregularity in the acceptance potential, which is a characteristic of the electrophotographic photosensitive member. That is, the potentials on thinner portions of the layer are lower than those on the other portions. In addition, the thinner portions show relatively quick response (high sensitivity) to light exposure since the lower potentials of the thinner portions readily decrease on light exposure.

In such a case, while the low acceptance potential can be offset to maintain the reproduced image density constant, by the method of applying a bias voltage for toner development, the quicker response cannot be compensated. Accordingly, even though the black portions of the reproduced images can be kept at a constant image density, the reproduced images of plotting paper, photographs, catalogues, posters, pencil-written letters, etc. having half-tone show low image densities on the thinner portions of the coat, forming obscure images.

SUMMARY OF THE INVENTION

Objects of the invention are to provide an electrophotographic photosensitive member and a method for producing the member which does not cause image irregularlity even when the charge transport layer has such uneven thickness as noted above.

The invention is constructed of an electrophotographic photosensitive member having a photosensitive laminate comprising a charge generation layer and a charge transport layer, characterized in that the thickness of the charge generation layer is controlled to increase continuously downward from the upper end thereof to a certain level H and the thickness of the charge transport layer laminated on the charge generation layer increases continuously downward from the upper end to the level H.

The invention is further constructed of a method for producing electrophotographic photosensitive members having a photosensitive laminate comprising a charge generation layer and a charge transport layer, characterized in that the take-up speed in the dip coating to form the charge generation is continuously increased from the start of the take-up to a certain take-up height H.

In other words, the invention is characterized in that the quicker response of the thinner portion of the charge transport layer is offset by decreasing the thickness of the corresponding portion of the charge generation layer. A thinner portion of the charge generation layer shows relative low sensitivity. That is, since the sensitivity of the electrophotographic photosensitive member also changes with the thickness of the charge generation layer, the locally quicker response owing to the locally thinner thickness of the charge transport layer can be prevented by decreasing previously the thickness of the corresponding portion of the charge generation layer.

According to the present invention, there is provided an electrophotographic photosensitive member having a conductive substrate and a photosensitive laminate comprising a charge generation layer and a charge transport layer formed by dip coating, characterized in that the charge transport layer has a portion where the thickness increases gradually from the upper end of the layer and the charge generation layer has a portion formed, correspondingly to the increasing thickness portion of the charge transport layer, so as to increase the thickness gradually from the upper end of the layer.

DETAILED DESCRIPTION OF THE INVENTION

Figure 1:
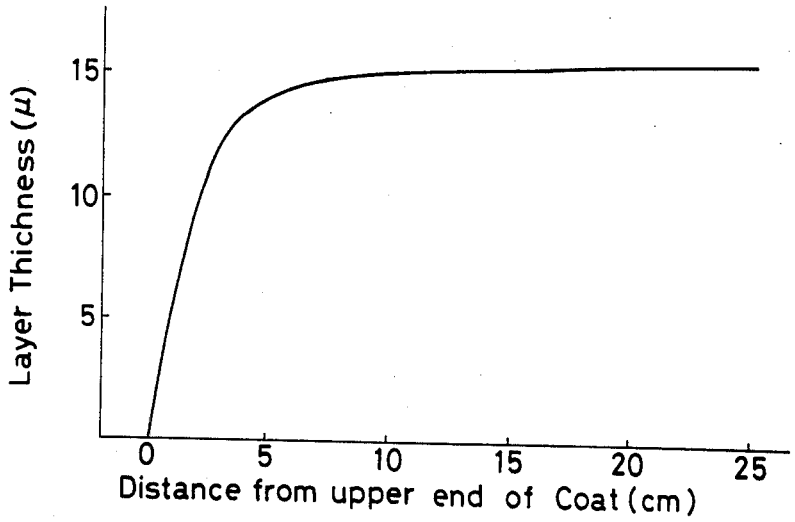
FIGS. 1, 2, 3, 5 and 6 are graphs showing the thickness distribution in a charge transport layer, the relation between the thickness of the charge generation layer and the sensitivity of the photosensitive member, the relation between the thickness of the charge transport layer and the sensitivity of the photosensitive member, the relation between the take-up speed and the thickness of a charge generation layer in the formation thereof by dip coating, and an example of the mode of take-up speed change in the dip coating to form a charge generation layer, respectively
Figure 2:
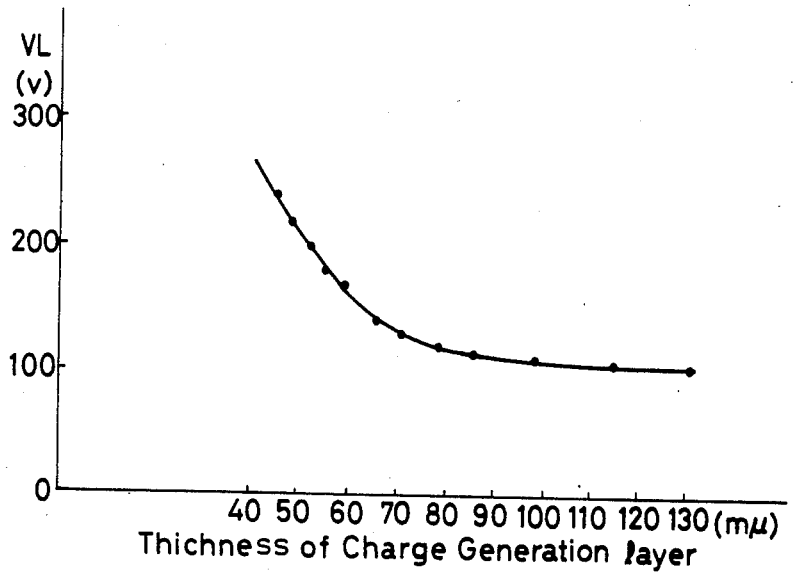

FIG. 2 shows the relation between the thickness of the charge generation layer and the sensitivity of the electrophotographic photosensitive member, wherein the sensitivity is represented by the potential ($V_L$) resulting when a definite light exposure is given to the charged photosensitive member. This relation was determined when the thickness of the charge transport layer is uniform (15$\mu$ as shown in FIG. 1). The thickness of the charge generation layer was measured according to the method disclosed in Japanese Patent Application Laid-Open No. 150,806/83. FIG. 2 shows that the $V_L$ plotted as ordinate decreases i.e. the response becomes quicker, with an increase in the layer thickness plotted as abscissa.

Figure 3:
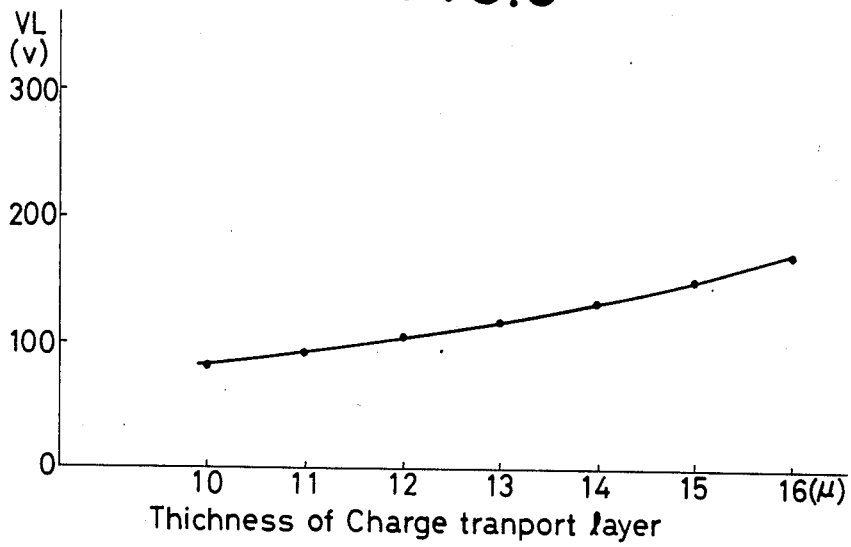

On the other hand, FIG. 3 shows the relation between the thickness of the charge transport layer and the sensitivity of the electrophotographic photosensitive member where the thickness of the charge generation layer is a definite value of 65 m$\mu$. The $V_L$ indicated on the ordinate increases with an increase in the layer thickness indicated on the abscissa.

Figure 4:
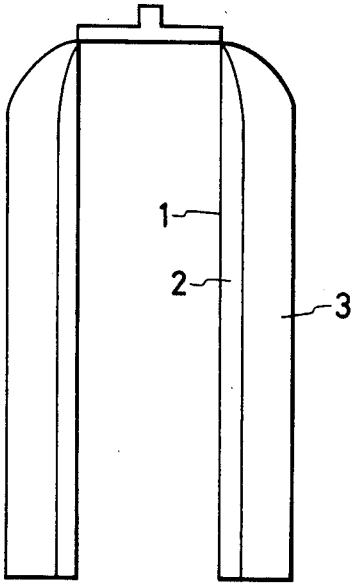
FIG. 4 is a schematic cross-sectional view of an electrophotographic photosensitive member according to the invention.

Accordingly, when the optimum thickness of the charge generation layer is, for instance, 65 m$\mu$, the portions of the charge generation layer which correspond to the portions of the charge transport layer which are predicted to be thinner than 15$\mu$ should be made thinner than the optimum thickness so that the sensitivity will be constant. FIG. 4 is a schematic representation of the thus changed thickness distributions of the charge generation and charge transport layers of an electrophotographic photosensitive member. In the figure, 1 is the substrate, 2 is the charge generation layer, and 3 is the charge transport layer. The electrophotographic photosensitive member of the invention is constructed like this.

As stated already, the coat to form the charge transport layer is liable to sag on the upper side during the take-up, while the coat to form the charge generation layer scarcely sags during the take-up because the charge generation layer is extremely thin and the viscosity of the coating solution for this layer is low. In consequence, coating conditions must be controlled in order to change the thickness of the charge generation layer at the upper portion, as desired, with the height. This problem has been solved by the method of the invention for producing electrophotographic photosensitive members, which is characterized in that the take-up speed in the dip coating to form the charge generation layer is put down when a portion (the uppermost portion) of the coat which is intended to be thin is passed across the coating solution level, and thereafter is increased continuously.

Figure 5:
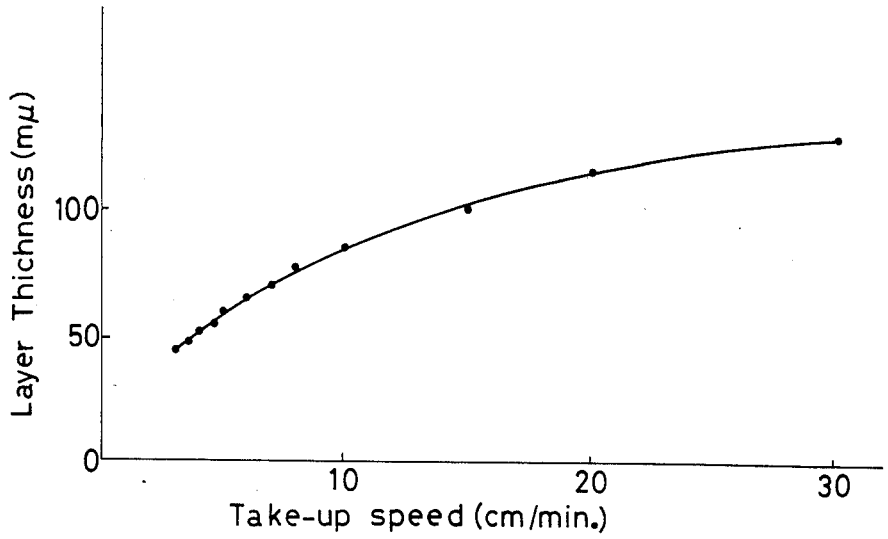
Figure 6:
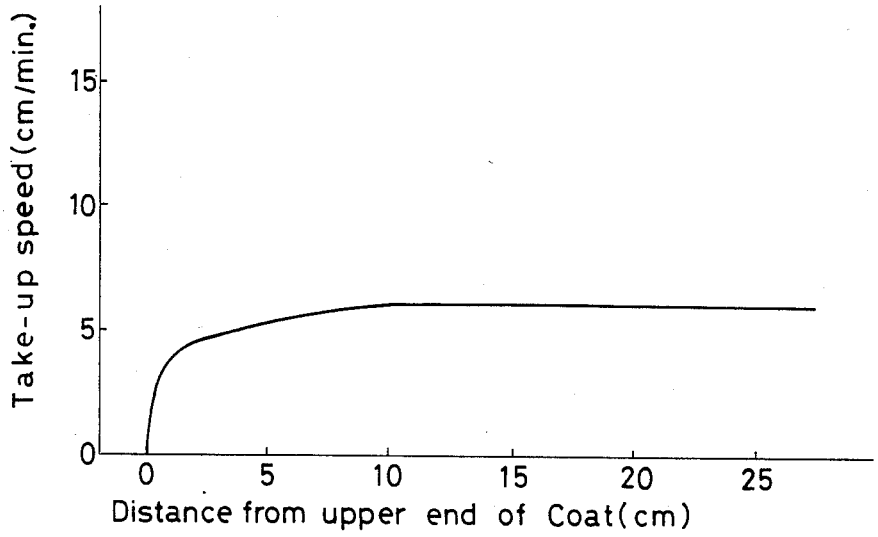

FIG. 5 shows the relation between the take-up speed and the thickness of a charge generation layer when the concentration of the coating solution is at a definite value. The take-up speed is plotted as abscissa and the thickness of a charge generation layer at the height corresponding to that speed as ordinate. Accordingly, the take-up speed to attain the desired coating thickness can be determined from FIG. 5. FIG. 6 shows such a mode of take-up speed change in dip coating for a charge generation layer as to give a thickness distribution of the layer as shown in FIG. 4. The distance from the upper end of the coat to an arbitrary position on the coat is plotted as abscissa against the take-up speed corresponding to the position as ordinate. Continuous increase of the take-up speed, like this, from the upper end of the coat to a certain lower level thereon can be accomplished by controlling a motor for take-up with an electronic circuit or the like.

The electrophotographic photosensitive member of the invention comprises a charge generation layer having such a thickness distribution as stated above and a charge transport layer thereupon having a similar thickness distribution, wherein the thickness increases from the top to the same level as defined on the charge generation layer. Thus the sensitivity of the photosensitive member can be kept uniform and therefore images free of uneven density can be reproduced.

More detailed description of the electrophotographic photosensitive member according to the invention is given below.

In the first place, the substrate is a cylinder formed of a material selected from metals such as aluminum, brass, stainless steel, and the like, macromolecular materials such as poly(ethylene terephthalate), poly(butylene terephthalate), phenolic resin, polypropylene, nylon, polystyrene, and the like, and rigid paper. When the material is an insulator, the conductivization treatment is necessary. Such treatment includes impregnation with a conductive substance, lamination of a metal foil, and vapor deposition of a metal. When the substrate surface is coarse, a conductive paint may be applied thereon to make the surface smooth. For the conductive paint there may be used dispersions of one or more powders of; metals such as aluminum, copper, silver, gold, nickel, and the like; metal oxides such as tin oxide, indium oxide, antimony oxide, titanium oxide, zinc oxide, and the like; and carbon; in solutions of resins such as polyurethane, epoxy resin, alkyd resin, polyester, acrylic resin, melamine resin, silicone resin, phenolic resin, and the like. The thickness of the conductive layer formed from the conductive paint is desired to be at least square of the surface roughness of the substrate.

The substrate is covered, if necessary, with a subbing layer. This layer serves to improve the adhesion of the charge generation layer to the substrate or to the conductive coat, improve coating workability for the charge generation layer, prevent defects in the coat, protect from electrical breakdown, and improve the charge injection property. Suitable materials for the subbing layer include, for example, poly(vinyl alcohol), methyl cellulose, ethyl cellulose, casein, gelatin, and polyamide (soluble nylon such as copolymerized nylon or nylon 8).

The charge generation layer is formed from a charge-generating material dispersed in a binder resin solution. Suitable charge-generating materials include, for example; azo pigments such as Sudan Red, Dayan Blue, and Genus Green B; disazo pigments; quinone pigments such as Argol Yellow and pyrenequinone; quinocyanine pigments; perylene pigments; indigo pigments such as indigo and thioindigo; bis(benzimidazole) pigments such as Indo Fast Orange Toner; phthalocyanine pigments such as copper phthalocyanine; quinacridone pigments; and pyrylium dyes. Suitable binder resins include, for example, polyester, poly(vinyl acetate), acrylic resin, poly (vinyl butyral), polyvinylpyrrolidone, methyl cellulose, hydroxypropylmethyl cellulose, and cellulose esters. The thickness of the charge generation layer is of the order of 0.04 to 0.2μ. As shown in FIG. 2, a thick charge generation layer exhibits quick response while a thin charge generation layer slow response.

The charge transport layer is formed from a charge-transporting material having low solubility in solvents, dissolved in a film-forming resin solution. Suitable charge-transporting materials include; compounds having an aromatic polycyclic structure such as anthracene, pyrene, phenanthrene, or coronene in the main chain or as a side chain; compounds having a similarly a nitrogen-containing cyclic structure such as indole, carbazole, oxazole, isoxazole, thiazole, imidazole, pyrazole, oxadiazole, pyrazoline, thiadiazole, or triazole; and compounds having similarly a hydrazone structure (>C=N—N<). Suitable film-forming resins include, for example, polycarbonate, polyarylate, polystyrene, polymethacrylic esters, styrene-methyl methacrylate copolymer, polyester, styrene-acrylonitrile copolymer, and polysulfone. The thickness of the charge transport layer is of the order of 5 to 20μ.

EXAMPLE

Aluminum hollow cylinders (60 mmϕ×260 mmh) having a closed top and an open bottom were used as substrates.

3 parts (by weight, hereinafter "part" means "part by weight") of a copolymerized nylon (tradename: CM8000, mfd. by Toray Industries Inc.) and 3 parts of a nylon 8 (tradename: EF30, mfd. by Teikoku Kagaku Co., Ltd.) were dissolved in a mixture of 60 parts of methanol and 40 parts of 1-butanol, and applied on the substrates by dip coating, forming subbing layers.

Then a charge generation layer was formed on each subbing layer as follows:

10 parts of a disazo pigment represented by the formula

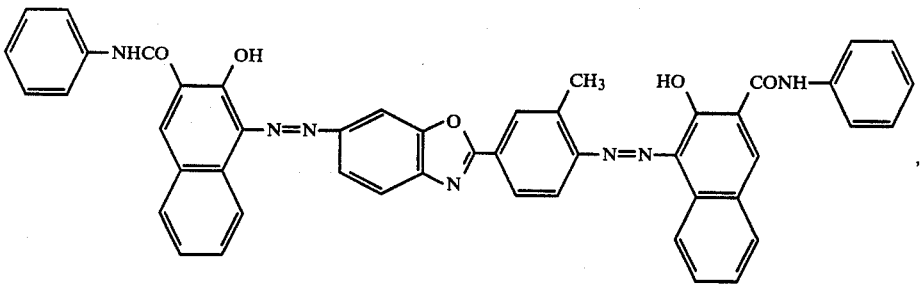

6 parts of a cellulose acetate butyrate resin (tradename: CAB-381, mfd. by Eastman Chemical Products Inc.) and 60 parts of cyclohexanone were ground for 20 hours in a sand mill using 1-mmϕ glass beads. To the resulting dispersion was added 100 parts of methyl ethyl ketone to prepare a coating liquid. This coating liquid is fed in an applicator vessel. One of the substrates coated with the subbing layer was dipped in the coating liquid, and then taken up while increasing the speed gradually from 0 to 6 cm/min. as shown in FIG. 6. After the substrate had been taken up by 8 cm, the take-up speed was kept at a constant value of 6 cm/min. Therefore, the coating thickness increased continuously from the upper end of the coat to the 8-cm lower level and thereunder was a constant value of 65 mμ. The coat was dried at 50° C. for 10 minutes to form a charge generation layer.

10 parts of a hydrazone compound represented by the formula

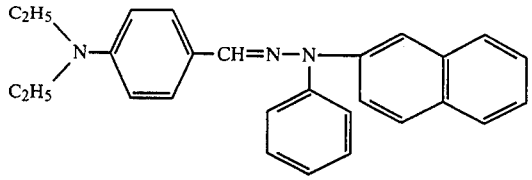

and 15 parts of a styrene-methyl methacrylate copolymer (tradename: MS 200, mfd. by Shinnittetsu Kagaku Co., Ltd.) were dissolved in 80 parts of toluene to prepare a coating solution. This solution was fed in an applicator vessel, and the substrate coated with the charge generation layer was dipped in the solution, and then taken up at a speed of 10 cm/min. The coat was dried by heating at 100° C. for 1 hour. The coating thickness was as shown in FIG. 1.

The thus prepared electrophotographic photosensitive member was set in an electrophotographic copying machine which was provided with the stages of ⊖6 KV corona charging, image exposure, jumping type development with a bias of ⊖150 V, toner image transfer onto plain paper, cleaning with an urethane rubber blade (hardness 70°, contact pressure 10 g/cm, angle to the photosensitive member surface: 20°), and the like, and electrophotographic characteristics of the member were evaluated.

The found dark area potential $V_D$ was −700 V on the middle region of the photosensitive member and was nearly uniform on the region below the level about 8 cm lower from the upper end of the coat. Upward from the level, the $V_D$ decreased gradually. The $V_L$ measured as sensitivity was nearly uniform throughout the entire region of the photosensitive member. It may be noted that the upper end of the image area was 1.5 cm lower from the upper end of the coat.

In the case of a photosensitive member prepared, on the other hand, through forming the charge generation layer at a constant take-up speed of 6 cm/min., the $V_L$ on the upper portion decreased upward. As regards reproduced images, no difference was found between the two photosensitive member in the case of a whole surface black original. But, in the case of a plotting paper original, the photosensitive member according to the invention, exhibited uniform image density, while the photosensitive member prepared through forming the charge generation layer at a constant speed exhibited low image density on the portion corresponding to the upper portion of the coat.

What we claim is:

1. An electrophotographic photosensitive member having a cylindrical conductive substrate and a photosensitive laminate of a charge generation layer and a charge transport layer wherein the charge transport layer has a portion having a layer thickness distribution which is continuously reduced toward an end of the member and wherein the charge generation layer has a layer thickness distribution corresponding to the layer thickness distribution of said charge transport layer.

2. The electrophotographic photosensitive member of claim 1, wherein the charge generation layer and charge transport layer each have a uniform thickness portion and wherein the uniform thickness portion of the charge generation layer has a thickness of from 0.04 to 0.2$\mu$.

3. The electrophotographic photosensitive member of claim 1, wherein the photosensitive laminate has substantially uniform sensitivity over the entire area.

4. The electrophotographic photosensitive member of claim 1, wherein the charge generation layer contains a charge-generating material selected from the group consisting of azo pigments, disazo pigments, quinone pigments, quinocyanine pigments, perylene pigments, indigo pigments, bis(benzimidazole) pigments, phthalocyanine pigments, quinacridone pigments, and pyrylium dyes.

5. The electrophotographic photosensitive member of claim 1, wherein the charge transport layer contains a charge-transporting material which is an electron donative or electron attractive material having low solubility in solvents.

6. The electrophotographic photosensitive member of claim 5, wherein the charge-transporting material is a compound having an aromatic polycyclic structure or a nitrogen-containing cyclic structure or a compound having a hydrazone structure.

7. The electrophotographic photosensitive member of claim 6, wherein the aromatic polycyclic structure is selected from the group consisting of anthracene, pyrene, phenanthrene, and coronene structures.

8. The electrophotographic photosensitive member of claim 6, wherein the nitrogen-containing cyclic structure is selected from the group consisting of indole, carbazole, oxazole, isoxazole, thiazole, imidazole, pyrazole, oxadiazole, pyrazoline, thiadiazole, and triazole structures.

9. The electrophotographic photosensitive member of claim 5, wherein the charge-transporting material has a hydrazone structure.

10. The electrophotographic photosensitive member of claim 1, wherein the uniform-thickness portion of the charge transport layer has a thickness of from 5 to 20$\mu$.

11. The electrophotographic photosensitive member of claim 1, which has a subbing layer between the conductive substrate and the photosensitive layer.

12. In the process for producing an electrophotographic photosensitive member having a cylindrical conductive substrate and a photosensitive laminate of a charge generation layer and a charge transport layer by sequentially dip coating the substrate from an upper end to a lower end into a charge generation coating solution and wherein the charge transport layer has a portion having a layer thickness distribution which is continuously reduced toward the upper end portion of the substrate which results in imaging irregularities in said member, the improvement by means of which the imaging irregularities are inhibited, which comprises: forming a charge generation layer having a layer thickness distribution which corresponds to the layer thickness distribution of said charge transport layer.

13. The process of claim 12 including increasing continuously the take-up speed during the dip coating of the charge generation layer from the upper end to gradually increase the thickness of the charge generation layer from a thinner portion at the upper end to a thicker portion to correspond with the change in thickness of the charge transport layer.

14. The process of claim 13 including continuously increasing the take-up speed from 0 to 6 cm/min.

* * * * *